US008186905B2

(12) United States Patent
Castro et al.

(10) Patent No.: US 8,186,905 B2
(45) Date of Patent: May 29, 2012

(54) APPARATUSES, SYSTEMS AND METHODS FOR SELECTIVELY AFFECTING MOVEMENT OF A MOTOR VEHICLE

(75) Inventors: Mynor J. Castro, Chandler, AZ (US); Robert Arthur McCoy, Phoenix, AZ (US); William Grant Seeglitz, Glendale, AZ (US); Edwin Allen Spomer, Peoria, AZ (US)

(73) Assignee: Pacific Scientific Energetic Material Company (Arizona), LLC, Chandler, AZ (US)

( * ) Notice: Subject to any disclaimer, the term of this patent is extended or adjusted under 35 U.S.C. 154(b) by 0 days.

(21) Appl. No.: 12/569,872

(22) Filed: Sep. 29, 2009

(65) Prior Publication Data

US 2010/0196092 A1 Aug. 5, 2010

Related U.S. Application Data

(60) Provisional application No. 61/101,142, filed on Sep. 29, 2008.

(51) Int. Cl.
*E01F 15/00* (2006.01)

(52) U.S. Cl. ..... 404/6

(58) Field of Classification Search ..... 404/6, 9
See application file for complete search history.

(56) References Cited

U.S. PATENT DOCUMENTS

| | | | | |
|---|---|---|---|---|
| 3,456,920 | A | 7/1969 | Elvington | |
| 5,322,385 | A | 6/1994 | Reisman | |
| 5,330,285 | A | 7/1994 | Greves et al. | |
| 5,452,962 | A | 9/1995 | Greves | |
| 5,507,588 | A | 4/1996 | Marts et al. | |
| RE35,373 | E | 11/1996 | Kilgrow et al. | |
| 5,775,832 | A | 7/1998 | Kilgrow et al. | |
| 5,820,293 | A | 10/1998 | Groen et al. | |
| 5,839,849 | A | 11/1998 | Pacholok et al. | |
| 5,871,300 | A | 2/1999 | Ingham | |
| 5,890,832 | A | 4/1999 | Soleau | |
| 5,904,443 | A | 5/1999 | Soleau | |
| 6,155,745 | A * | 12/2000 | Groen et al. | 404/6 |
| 6,206,608 | B1 * | 3/2001 | Blevins | 404/6 |
| 6,220,781 | B1 * | 4/2001 | Miller | 404/6 |
| 6,224,291 | B1 | 5/2001 | Mateychuk | |
| 6,322,285 | B1 * | 11/2001 | Ben | 404/6 |

(Continued)

FOREIGN PATENT DOCUMENTS

WO WO-2009090370 A1 7/2009

OTHER PUBLICATIONS

International Search Report and Written Opinion, International Application No. PCT/US2009/058892, Filed on Sep. 29, 2009, Applicant: Pacific Scientific Energetic Materials Company, Mailed on Nov. 19, 2009, 10 pages.

(Continued)

*Primary Examiner* — Raymond W Addie
(74) *Attorney, Agent, or Firm* — Perkins Coie LLP

(57) ABSTRACT

A non-lethal vehicle device provides for the selective, remotely-deployed controlled stop of a targeted vehicle regardless of wheel or undercarriage configuration. The device is comprised of a combination of a remote arm/safe mechanism, a remote deployment controller, spike/membrane deployment mechanism(s), a "speed bump" type housing that can protrude (be driven over until deployed) or be submerged, and one or more membranes with a plurality of spikes. A combination of sensors may provide independent deployment once armed.

27 Claims, 5 Drawing Sheets

U.S. PATENT DOCUMENTS

| | | | | |
|---|---|---|---|---|
| 6,409,420 | B1 | 6/2002 | Horton et al. | |
| 6,474,903 | B1 | 11/2002 | Marts et al. | |
| 6,527,475 | B1 * | 3/2003 | Lowrie | 404/6 |
| 6,551,013 | B1 * | 4/2003 | Blair | 404/6 |
| 6,623,205 | B1 | 9/2003 | Ramirez | |
| 6,716,234 | B2 | 4/2004 | Grafton et al. | |
| 6,758,628 | B1 * | 7/2004 | Curry, Jr. | 404/6 |
| 6,997,638 | B2 | 2/2006 | Hensley et al. | |
| 7,011,470 | B1 | 3/2006 | Breazeale et al. | |
| 7,025,526 | B2 | 4/2006 | Blair | |
| 7,201,531 | B2 | 4/2007 | Shackelford et al. | |
| 7,220,076 | B2 * | 5/2007 | Boll | 404/6 |
| 7,226,238 | B2 * | 6/2007 | Collier | 404/6 |
| 7,441,982 | B1 | 10/2008 | Al-Sabah | |
| 7,524,134 | B2 | 4/2009 | Rastegar et al. | |
| 7,573,379 | B2 | 8/2009 | Moormeier et al. | |
| 2005/0244223 | A1 | 11/2005 | Shackelford et al. | |
| 2006/0140715 | A1 | 6/2006 | Lyddon et al. | |
| 2006/0260210 | A1 | 11/2006 | Tanielian et al. | |
| 2007/0264079 | A1 | 11/2007 | Martinez et al. | |
| 2008/0060271 | A1 | 3/2008 | Beniamin et al. | |
| 2008/0124171 | A1 | 5/2008 | Moormeier et al. | |
| 2009/0163095 | A1 | 6/2009 | Weinel et al. | |
| 2010/0086349 | A1 | 4/2010 | Martinez et al. | |
| 2010/0196092 | A1 | 8/2010 | Castro et al. | |
| 2010/0221066 | A1 | 9/2010 | Martinez et al. | |

OTHER PUBLICATIONS

International Search Report and Written Opinion, International Application No. PCT/US2009/059554, Filed on Oct. 5, 2009, Applicant: Pacific Scientific Energetic Materials Company, Mailed on Dec. 4, 2009, 11 pages.

International Search Report and Written Opinion, International Application No. PCT/US2010/053425, Filed on Oct. 20, 2010, Applicant: Pacific Scientific Energetic Materials Company, Mailed on Dec. 13, 2010, 11 pages.

International Search Report and Written Opinion, International Application No. PCT/US2010/053428, Filed on Oct. 20, 2010, Applicant: Pacific Scientific Energetic Materials Company, Mailed on Dec. 13, 2010, 8 pages.

* cited by examiner

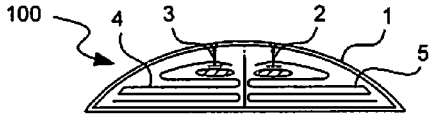
FIG. 1A
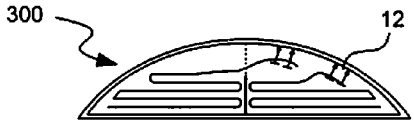
FIG. 4A
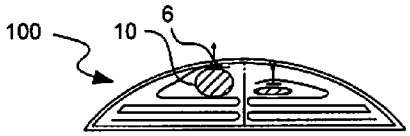
FIG. 1B
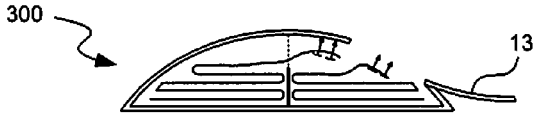
FIG. 4B
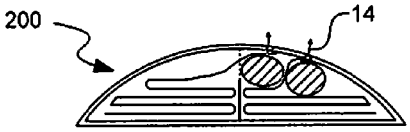
FIG. 3A
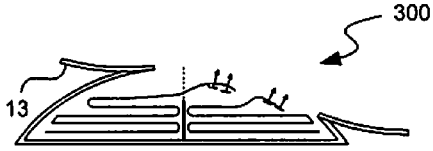
FIG. 4C
FIG. 2
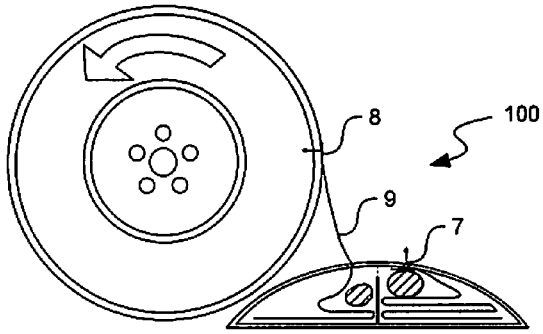
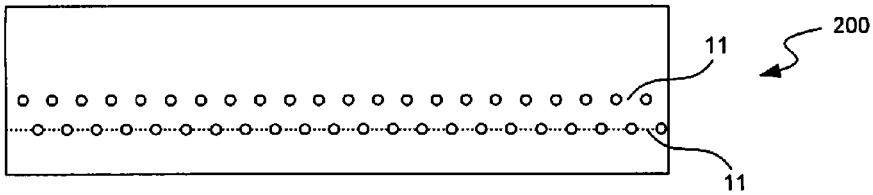
FIG. 3B

APPARATUSES, SYSTEMS AND METHODS FOR SELECTIVELY AFFECTING MOVEMENT OF A MOTOR VEHICLE

CROSS-REFERENCE TO RELATED APPLICATION(S)

This patent application claims the benefit under 35 U.S.C. §119 of U.S. Provisional Patent Application No. 61/101,142, filed on Sep. 29, 2008, entitled "A System and Method for Motor Vehicle Restraint," which is incorporated herein in its entirety by reference.

TECHNICAL FIELD

The present disclosure relates generally to apparatuses, systems and methods for affecting movement of a land vehicle. In particular, the present disclosure relates to apparatuses, systems and methods for selectively deterring, restraining and/or immobilizing a motor vehicle by entangling one or more tires on the vehicle.

BACKGROUND

Conventional devices for slowing, disabling, immobilizing and/or restricting the movement of a land vehicle include barriers, tire spike strips, caltrops, snares and electrical system disabling devices. For example, conventional spike strips include spikes projecting upwardly from an elongated base structure that is stored as either a rolled up device or an accordion type device. These conventional spike strips are unfurled or unfolded and placed on a road in anticipation that an approaching target vehicle will drive over the spike strip. Successfully placing a conventional spike strip in the path of a target vehicle results in one or more tires of the target vehicle being impaled by the spike(s), thereby deflating the tire(s). This can make it difficult for the driver to maintain control of the vehicle and can result in personal injury and/or property damage.

Conventional devices may be used by first response personnel, law enforcement personnel, armed forces personnel or other security personnel. It is frequently the case that these personnel must remain in close proximity when deploying these devices. For example, a conventional method of deploying a spike strip is to have the personnel toss the spike strip in the path of an approaching target vehicle. This conventional method places the security personnel at risk insofar as the driver of the target vehicle may try to run down the security personnel or the driver may lose control of the target vehicle while attempting to maneuver around the spike strip and hit the security personnel. Further, rapidly deflating only one of the steering tires may cause a target vehicle to careen wildly and possibly strike nearby security personnel, bystanders, or structures.

Accordingly, there are a number of disadvantages of conventional devices including difficulty deploying these devices in the path of a target vehicle and/or the risk to security personnel while deploying or retracting these devices. The proximity of the security personnel to the target vehicle when the vehicle encounters these devices also may place the security personnel at risk of being struck by the vehicle. Further, these devices have limited or no ability to selectively engage a target vehicle and allow other vehicles to safely pass.

BRIEF DESCRIPTION OF THE DRAWINGS

FIG. 1A is a schematic view illustrating a vehicle immobilizing device in a first configuration according to an embodiment of the present disclosure.

FIG. 1B is a schematic view illustrating the vehicle immobilizing device shown in FIG. 1A in a second configuration.

FIG. 2 is a schematic illustration of a method according to an embodiment of the present disclosure for immobilizing a vehicle using the device shown in FIGS. 1A and 1B.

FIG. 3A is a schematic view illustrating a vehicle immobilizing device according to another embodiment of the present disclosure.

FIG. 3B is a plan view showing the vehicle immobilizing device of FIG. 3A.

FIG. 4A is a schematic view illustrating a vehicle immobilizing device in a first configuration according to yet another embodiment of the present disclosure.

FIG. 4B is a schematic view illustrating the vehicle immobilizing device shown in FIG. 3A in a second configuration.

FIG. 4C is a schematic view illustrating the vehicle immobilizing device shown in FIG. 3A in a third configuration.

DETAILED DESCRIPTION

A. Overview

Figure 5:
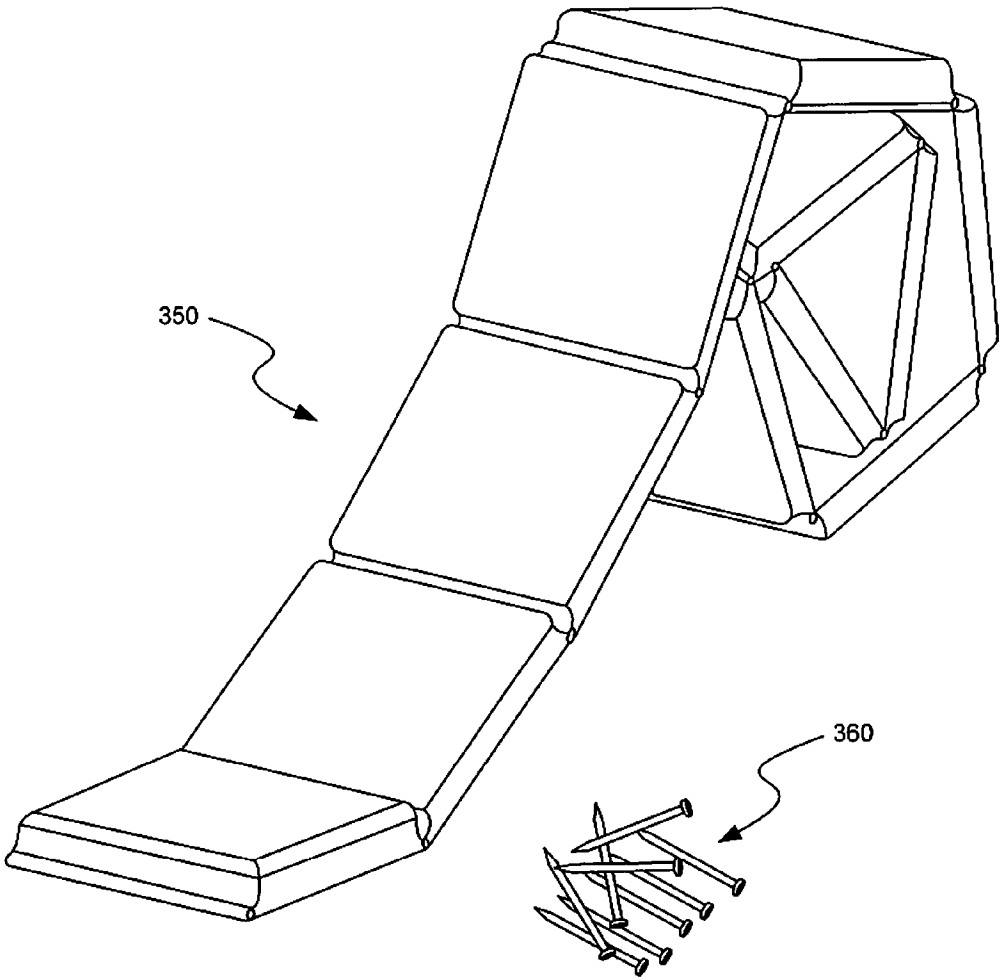
FIG. 5 is a perspective view of a vehicle immobilizing device according to a further embodiment of the present disclosure.

Embodiments in accordance with the present disclosure are set forth in the following text to provide a thorough understanding and enabling description of a number of particular embodiments. Numerous specific details of various embodiments are described below with reference to immobilization devices for vehicles having tires engaging a paved surface, but embodiments can be used with other ground engaging features (e.g., tracks) and with other types of terrain (e.g., dirt, gravel, and other non-paved surfaces). In some instances, well-known structures or operations are not shown, or are not described in detail to avoid obscuring aspects of the inventive subject matter associated with the accompanying disclosure. For example, a wheel may generically refer to a wheel having a tire mounted on the wheel. A person skilled in the art will understand, however, that the invention may have additional embodiments, or that the invention may be practiced without one or more of the specific details of the embodiments as shown and described.

Aspects of the present invention are generally directed to an apparatus for affecting movement of a vehicle that includes a rotating wheel. One aspect of embodiments is directed toward an apparatus including a housing configured to be positioned in a path of the vehicle such that the rotating wheel crosses the housing, a membrane having a contracted arrangement and an extended arrangement, and a snagging member coupled to the membrane. The membrane is disposed in the housing in the contracted arrangement and is configured to wrap around the wheel in the extended arrangement. The snagging member is configured to snag the wheel in the contracted arrangement of the membrane.

Other aspects of the present invention are generally directed to a system for affecting movement of a vehicle that includes first and second rotating wheels. One aspect of embodiments includes a housing configured to be positioned in a path of the vehicle such that the first and second rotating wheels cross the housing, first and second membranes having contracted and extended arrangements, first and second sets of snags coupled to the first and second membranes, respectively, and a safe/armed mechanism configured to deploy an individual set of snags from a safe arrangement to an armed arrangement. The first membrane is disposed in the housing in its contracted arrangement and is configured to wrap around the first wheel in its extended arrangement. The second membrane is disposed in the housing in its contracted arrangement and is configured to wrap around the second wheel in its extended arrangement. Individual sets of snags are configured to extract an individual membrane from the housing between the contracted and extended arrangements, and individual snags are generally shielded by the housing in the safe arrangement and are exposed in the armed arrangement.

Yet other aspects of the present invention are generally directed to a method for affecting movement of a vehicle that includes a rotating wheel. One aspect of embodiments includes positioning a housing in a path of the vehicle such that the rotating wheel crosses the housing, the housing enclosing a membrane and a snagging member coupled to the membrane, exposing the snagging member with respect to the housing, engaging the snagging member with the rotating wheel, and entangling the membrane around the rotating wheel.

Certain embodiments according to the present disclosure include a vehicle restraint system that entangles the wheels of a selected moving vehicle to deter, restrain, or immobilize the vehicle as it travels along a path. The vehicle restraint system includes a housing that has been installed or otherwise placed in the ground or on the roadway in the path of a targeted vehicle. In an exemplary embodiment, as the vehicle is driven over the housing, the front wheels of the vehicle become snagged by a membrane dispensed from the housing that wraps around the front wheels during rotation of the front wheels, while the back wheels of the vehicle become snagged by a second membrane dispensed from the housing that wraps during rotation of the back wheels. Upon entangling both the front and back wheels with the first and second membranes, the target vehicle slows to a stop. This can be accomplished without incurring permanent damage to the vehicle or injury to the vehicle driver.

Certain other embodiments according to the present disclosure include the housing configured as a protuberance that extends at least in part laterally across the width of a roadway. The membrane that is dispensed from the housing may include netting or a web-like material that is of sufficient strength to be twisted around vehicle tires to ensnare or entangle the vehicle tires. The housing may contain a first and/or second netting sub-system for engaging respectively with front and/or rear vehicle tires of an oncoming target vehicle. When the front tires of the target vehicle are driven over the housing, the netting/web-like material is dispensed from the first netting sub-system within the housing to engage with the front vehicle tires and ensnare or entangle the front tires during tire rotation. Likewise, when the rear tires of the target vehicle are driven over the housing, the netting/web-like material is dispensed from the second netting sub-system within the housing to engage with the rear vehicle tires and ensnare or entangle the rear tires during tire rotation. Once both sets of tires become entangled, the vehicle will slow to a stop, regardless of whether the vehicle is a front-wheel drive, rear-wheel drive, or all-wheel drive. In certain embodiments, the vehicle immobilizing device may include identified components to ensnare or entangle either the front or rear wheels of the target vehicle depending on the vehicle wheel configuration, e.g., front, rear, or other wheel drive.

The housing may be configured as a road protuberance that slightly bulges above a road surface, e.g., a "speed bump" (also referred to as a "speed hump," "road hump" or "sleeping policeman"). Alternatively, the housing may be configured to be installed in a cut-away in a road and seated flush with the pathway. In either manner, the housing may be configured such that its capability for vehicle immobilization is concealed from the driver of an oncoming vehicle.

Certain other embodiments according to the present disclosure include a system that can be selectively armed and disarmed. When disarmed, the system is placed into a "sleep" or "deactivated" mode in which vehicles may be driven over the housing without consequence, much like a conventional speed bump. When the system is armed, however, the system will snag the tires of the next vehicle that is driven across the housing. In certain embodiments, as hereinafter described, the system can be selectively armed and disarmed remotely via wired or wireless communication from a vehicle sensor and/or an operator controlled device.

Certain other embodiments according to the present disclosure include a housing having two openings, through which the first and second netting/web-like material is dispensed, e.g., one net per opening. The netting/web-like material may include a section in which barbs, spikes, nails or other types of snagging members are affixed or integrated with the material to engage with vehicle tires as they are driven across the openings in the housing. When the system is armed and a target vehicle is detected, the snagging members for the first netting/web-like material are positioned so as to protrude outward from the upper surface of the housing as the front vehicle wheels are being driven across a first opening in the upper housing. This causes the front wheels of the vehicle to become snagged. As the front wheels continue to rotate, the first netting/web-like material is pulled by the rotating wheel to extract the material from within the housing and become wrapped around the front rotating wheels. Likewise, the snagging members for the second netting/web-like material are positioned so as to protrude outward from the upper surface of the housing as the rear vehicle wheels are being driven across a second opening in the upper housing, thereby causing the rear wheels to become snagged by the spikes/barbs, causing the second netting/web-like material to be dispensed from the housing and become entangled around the rear rotating wheels.

The inventive subject matter as described in this disclosure is not limited to a system that utilizes two sets of netting/web-like material. In alternative embodiments, the vehicle immobilizing system may include netting/web-like material for engaging with only the front set of wheels, or only the rear set of wheels. In still other alternative embodiments, the netting/web-like material may be sized and configured to ensnare or entangle both the front and rear wheels on one side of the vehicle. Additionally, in embodiments in which two sets of netting/web-like material are employed, the housing may be configured such that both sets are dispensed serially from the same opening. In still other embodiments, a first netting/web-like material may be employed for the front wheels, whereas a different netting/web-like material may be employed for the rear wheels.

B. Embodiments of Apparatuses, Systems and Methods for Deterring, Restraining or Immobilizing a Vehicle FIGS. 1A and 1B are schematic views illustrating different configurations of a vehicle immobilizing device 100 according to an embodiment of the present disclosure. In particular, FIG. 1A illustrates a first or stowed configuration of the device 100 and FIG. 1B shows a second or deployed configuration of the device 100. In the stowed configuration shown in FIG. 1A, the device 100 can be packaged in the form of or housed in a speed-bump 1. Two series of snagging members, e.g., tire spikes 2 and 3, are disposed inside the speed-bump 1 in the stowed configuration. The material, size and shape of individual snagging members can be selected on the device 100 to penetrate into, latch onto, and/or penetrate through a tire as a vehicle drives over the device 100.

Coupled to the series of spikes 2 and 3 are packaged snaring members 4 and 5, respectively, that are also disposed inside the speed-bump 1 in the stowed configuration. Individual snaring members include a snaring net, a woven membrane, a combination thereof, or another suitable member for wrapping around a tire. Examples of materials for the snaring members can include polyethylene, Kevlar®, or another material that is suitably strong and flexible, and can be formed into fibers or a film that can be packaged inside the speed-bump 1. According to embodiments of the present disclosure, the length of individual snaring members can be at least approximately the circumference of a tire on a vehicle that is to be immobilized. For example, for a tire having a diameter or 33 inches, the length of the snaring members 4 and 5 can be at least approximately 90 inches. Sizes and shapes of individual snaring members can also be varied based on the anticipated size and potential speed of a vehicle that is expected to be immobilized. Individual snaring members can be packaged, e.g., accordion folded, rolled, or a combination thereof, within the speed-bump 1 so as to control the speed and withdrawal of the snaring member from the speed-bump 1.

In the second or partially deployed configuration of the device 100 shown in FIG. 1B, an exposed spike 6 is disposed outside of the speed-bump 1. The spike 6, which is one of the series of spikes 3, can be deployed pyrotechnically, mechanically (e.g., resiliently biased by a spring), electrically, pneumatically, or by any other suitable technique using an actuator 10. In the embodiment shown in FIG. 1B, an inflatable bladder 10 disposed inside the speed-bump 1 can be used to pneumatically deploy the spike 6. According to other embodiments, spikes can be deployed by various motions including translation, pivoting, combinations thereof, or any other suitable form of movement.

Referring additionally to FIG. 2, which illustrates a method according to an embodiment of the present disclosure for immobilizing a vehicle using the device 100, a tire T rolls over the initially deployed spike 6, which penetrates into and becomes latched onto the tire T. In a third or fully deployed configuration as shown in FIG. 2, the latched spike 8 unfold, un-spool, or otherwise withdraw the snaring member 9, which was previously packaged snaring member 4 in the stowed configuration. Also in the fully deployed configuration, a spike 7 from the series of spikes 2 is deployed to subsequently penetrate into and become latched onto a second tire, such as a rear tire (not shown). The spike 7 can be deployed by an actuator in a manner similar to that of spike 6.

FIGS. 3A and 3B are schematic views illustrating a vehicle immobilizing device 200 according to another embodiment of the present disclosure. As compared to the embodiment illustrated in FIGS. 1A and 1B, both series of spikes are disposed on the leading surface of the speed-bump 1. That is to say, the deployed spikes 14 are disposed inside the speed-bump 1 so as to subsequently project from the initial surface that is contacted and climbed by a tire (not shown) rolling over the device 200. In the embodiment shown in FIG. 3B, the spikes 14 may also be deployed through frangible seams 11 on the surface of the speed-bump 1.

FIGS. 4A to 4C illustrate a vehicle immobilizing device 300 according to yet another embodiment of the present disclosure. In the stowed configuration shown in FIG. 4A, series of spike sets 12 are disposed inside the speed-bump 1. As with other embodiments in accordance with the present disclosure, an individual spike set 12 can include plural barbs. For example, two barbs for each spike set 12 are illustrated in FIGS. 4A to 4C. In the partially deployed configuration shown in FIG. 4B, a first cover 13 can be actuated to expose a series of the spike sets 12. As with other embodiments according to the present disclosure, individual covers 13 can be actuated pyrotechnically, mechanically, electrically, pneumatically, or by any other suitable technique. In the fully deployed configuration shown in FIG. 4C, a second cover 13 can be actuated to expose another series of the spike sets 12. Accordingly, sequential exposure of two spike sets 12 can be achieved by a two-stage opening of covers 13.

FIG. 5 is a perspective view of a vehicle immobilizing device 350 according to a further embodiment of the present disclosure. The immobilizing device 350 is shown coiled so as to facilitate movement, installation, removal and relocation. Fasteners 360 can be used to securely position the device 350 to a road surface, e.g., asphalt, concrete, or another suitable firm surface. In other embodiments, the device 350 can be disposed within a housing (not shown). For example, the device 350 can be disposed within a recyclable housing shaped like a speed bump that can have a frangible seam through which the device 350 operates.

Figure 6A:
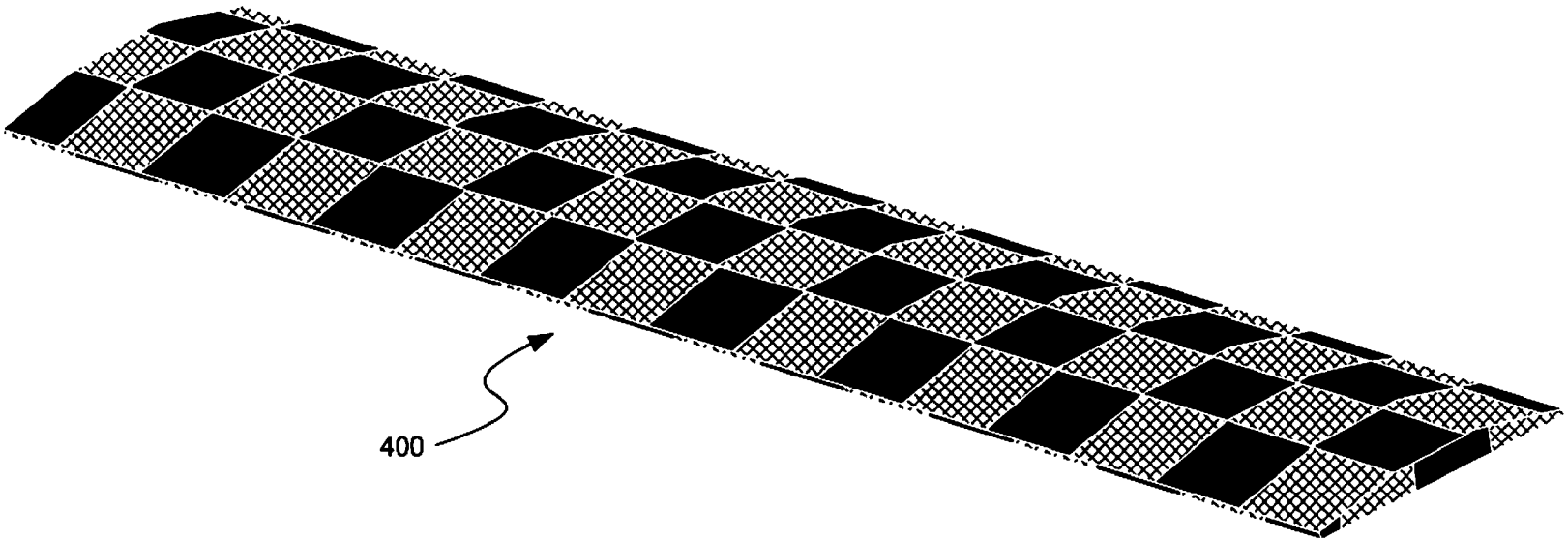
FIG. 6A is a first perspective view of a vehicle immobilizing device according to a yet further embodiment of the present disclosure.
Figure 6B:
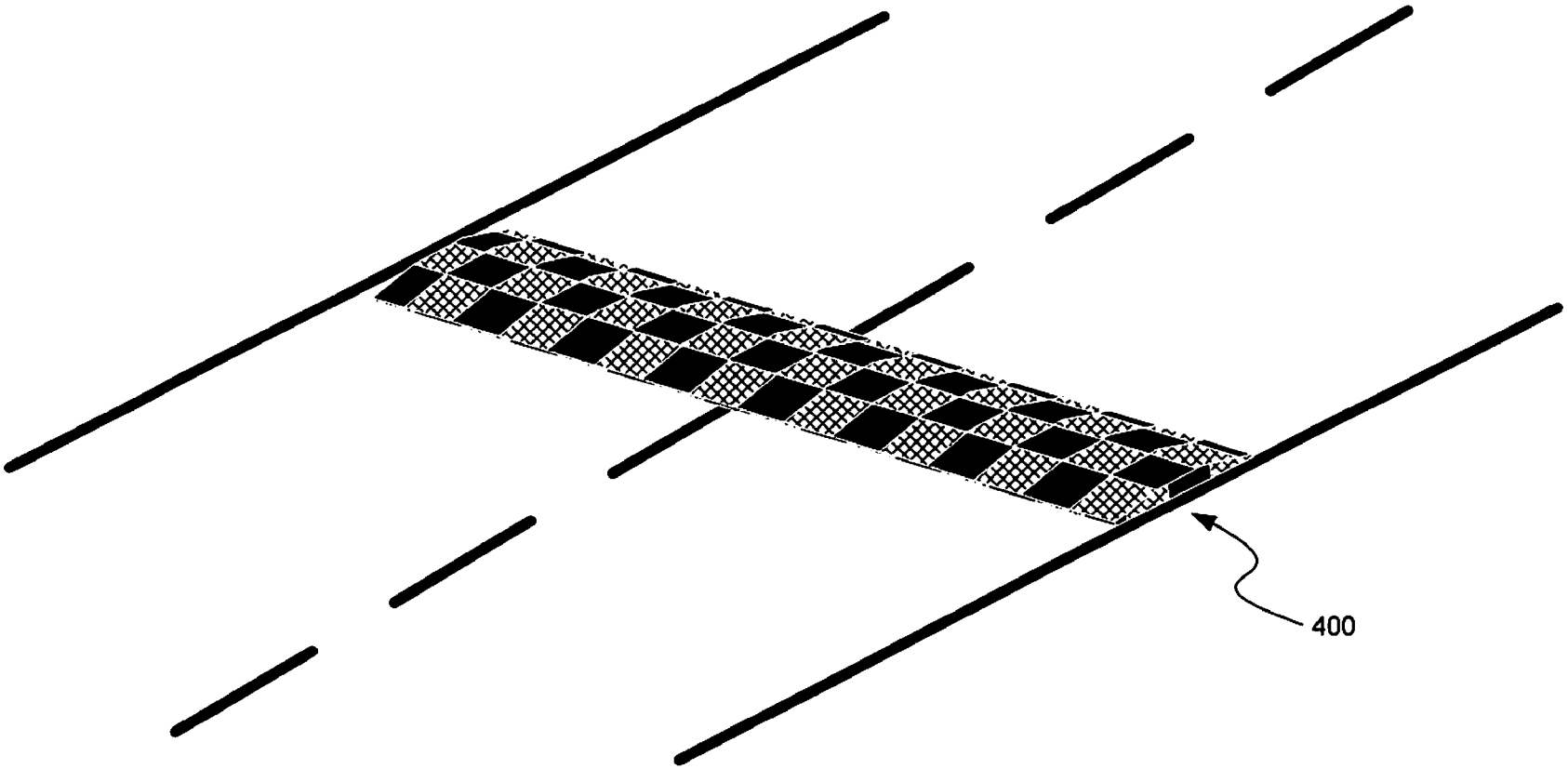
FIG. 6B is a second perspective view of the vehicle immobilizing device shown in FIG. 6A.
Figure 6C:
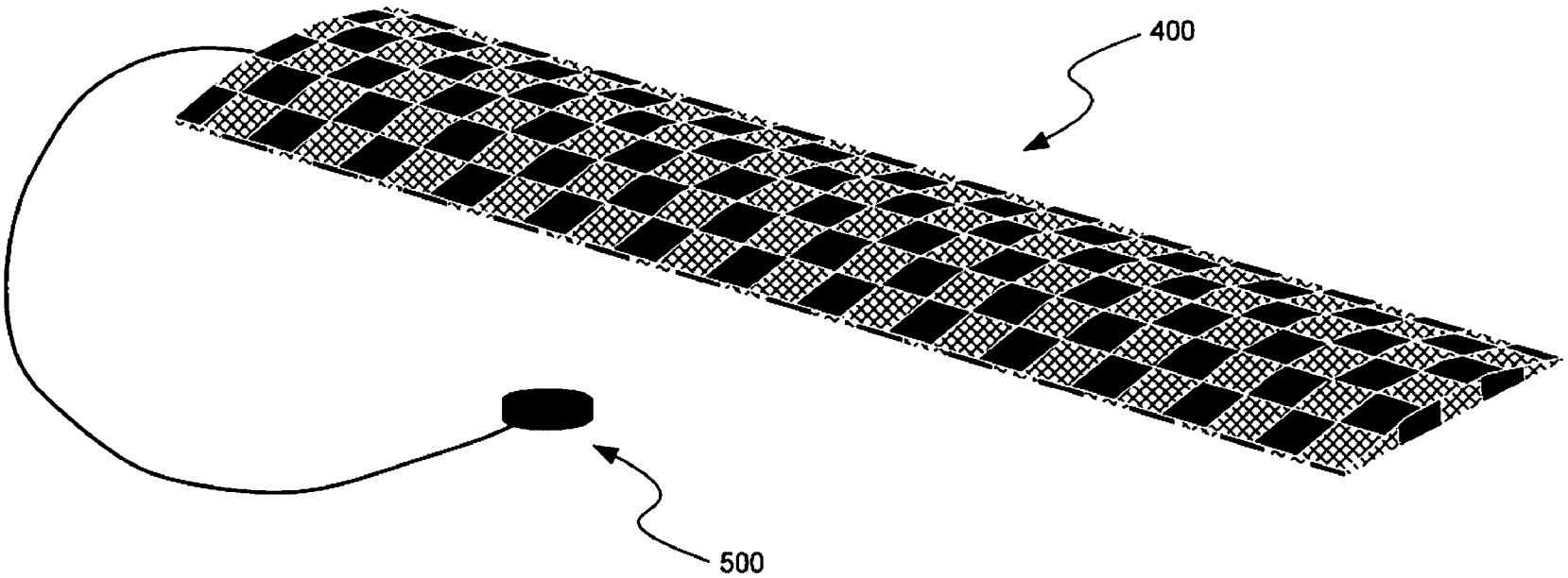
FIG. 6C is a third perspective view of the vehicle immobilizing device shown in FIG. 6A.

FIGS. 6A to 6C are perspective views of stowed configuration of a vehicle immobilizing device 400 according to a further embodiment of the present disclosure. In particular, FIGS. 6B and 6C show the device 400 arranged in suitable environments. In FIG. 65C, a sensor 500 for deploying the device 400 is shown disposed in front of the deploying device 400.

The sensor 500 can be used to determine the presence of a vehicle (not shown). For example, the sensor 500 can determine the presence of one or more characteristic of a vehicle including mass, heat, sound, electromagnetic field, vibration, motion, or another suitable property. Upon determining the presence of a vehicle, the sensor 500 can reconfigure one of the vehicle immobilizing devices 100, 200, 300 or 400 to the partially deployed configuration, e.g., actuating the actuator (s) 10 to deploy the first series of spikes 6 from the device 100.

According to other embodiments of the present disclosure, individual sensors can be disposed on or inside the speed-bump 1. For example, a pressure sensor can be disposed at the leading edge of the speed-bump 1 and can include an inflated bladder (not shown) that, when crushed by the vehicle (not shown), sends a pneumatic signal to a pneumatic actuator. Alternatively, a proximity sensor can send an electrical signal to a pyrotechnical actuator, or another suitable sensor can signal a corresponding suitable actuator.

A method according to embodiments of the present disclosure for implementing a vehicle immobilizing device will now be described. A vehicle immobilizing device 100, 200, 300 or 400 can be positioned in a "decision zone" that can be positioned prior to a "stop zone" at a checkpoint, an entry gate, or any other location at which it is desirable to screen vehicle traffic. A vehicle approaching the location would typically slow to allow security personnel manning the location to have an opportunity to investigate the vehicle as it comes to a stop in the decision zone. A friendly vehicle is typically allowed to pass through the decision zone and bypass the stop zone. In the event that a vehicle does not halt for investigation in the decision zone, the security personnel can selectively arm the vehicle immobilizing device 100, 200, 300 or 400 such that prior to the vehicle rolling over, for example, the vehicle immobilizing device 100, a sensor, e.g., sensor 500, will have deployed the spikes 6. As the vehicle rolls over the vehicle immobilizing device 100, the spikes 6 penetrate into and latch onto the leading tires of the vehicle. As the vehicle continues, the tires draw the snaring member 9 out of the speed-bump 1 and the snaring member 9 can twist and become entangled around the rotating tires. In turn, the spikes 7 are deployed out of the speed-bump 1 and penetrate into and latch onto the trailing tires of the vehicle. As the vehicle continues, the snaring member 5 is drawn out of the speed-bump 1 and can twist and become entangled around the rotating trailing tires. The entangled snaring members then will continue to twist until leverage against the under carriage of the vehicle brings the tires to a stop. Accordingly, the vehicle can be slowed and stopped in a controlled and non-lethal manner.

According to the present disclosure, other embodiments can include various features for deploying the trailing tire spikes. For example, the spikes 7 can be deployed after a time period that is less than the time it takes between the leading and trailing tires rolling over one of the vehicle immobilizing devices 100, 200, 300 or 400. For example, a smart logic timing device can be used to deploy the spikes 7 after a time period, e.g., not more than approximately 100 milliseconds, following deployment of the spikes 6. The trailing tire spikes can also be deployed upon the leading tire withdrawing a length of a snaring member, or based on contact of the trailing tires with the vehicle immobilizing device 100, 200, 300 or 400. Other techniques are suitable so long as the trailing tire spikes are deployed after the leading tire has rolled over the vehicle immobilizing device and before the trailing tire rolls on the vehicle immobilizing device.

According to the present disclosure, still other embodiments of can deploy the spikes by deflating or otherwise compressing the speed-bump to expose the spikes. Accordingly, the leading tires could deflate a first portion of a vehicle immobilizing device 100, for example, to expose and engage the spikes 6, and the trailing tires could subsequently deflate a second portion of the vehicle immobilizing device 100 to expose and engage the spikes 7.

According to the present disclosure, yet other embodiments can include a vehicle immobilizing device that is packaged in the form of or housed in a portable speed-bump that is meant to be positioned in the path of traffic at a selective location or pathway of traffic. The speed bump can also be used to slow down traffic and, unbeknownst to an operator of a particular vehicle, the speed bump can also selectively immobilize the particular vehicle with minimal damage and risk to the vehicle occupants.

According to the present disclosure, further embodiments of a vehicle immobilizing device can be remotely armed in anticipation of a particular vehicle. As the particular vehicle approaches the speed bump, the barbed spikes can be deployed from the speed bump to initiate a series of snaring events. Else, the vehicle immobilizing device can also be remotely disarmed prior to the vehicle reaching the speed-bump. Once disarmed, the vehicle immobilizing device can serve back as a conventional speed-bump for merely slowing traffic.

According to the present disclosure, still further embodiments of the vehicle immobilizing device can also be permanently or semi-permanently housed bellow the road grade on a drive way or pathway and remotely or directly activated in according to an aforementioned manner. According to other embodiments of the present disclosure, individual snaring members can be launched, e.g., pyrotechnically, from a housing toward the tires of a vehicle.

According to more embodiments of the present disclosure, spikes can be coupled to snaring members proximal to edges of the snaring members, at net joints (e.g., knots) of the snaring members, or distributed over the surface of the snaring members. A backing or doubling layer can be used to couple spikes to structural strands of a snaring member.

According to yet more embodiments of the present disclosure, spikes can be spring loaded or otherwise biased with respect to a housing of the speed-bump. Accordingly, releasing the spring or biasing element with an actuator can allow the spikes to be deployed.

Additional embodiments according to the present disclosure can include batteries or solar cells to provide electrical power for the vehicle immobilizing device, indicators for the state of the battery charge and whether the vehicle immobilizing device has been armed, self diagnostics to evaluate the operability of the vehicle immobilizing device, and wireless or wired controllers for remotely arming of the vehicle immobilizing device from a suitable distance. Moreover, embodiments according to the present disclosure can include reinforcements to withstand heavy vehicles passing over the vehicle immobilizing device or can include features for protecting the vehicle immobilizing device from exposure to various environments such as water or sand. Further, embodiments according to the present disclosure can be sized in accordance with the terrain and intended implementation of the vehicle immobilizing device, e.g., extending across a single traffic lane or more than one traffic lane.

From the foregoing, it will be appreciated that specific embodiments of the invention have been described herein for purposes of illustration, but that various modifications can be made without deviating from the spirit and scope of the invention. Accordingly, the invention is not limited by the specific embodiments.

What is claimed is:

1. An apparatus for affecting movement of a vehicle that includes a rotating wheel, the apparatus comprising:

a housing configured to be positioned in a path of the vehicle such that the rotating wheel crosses the housing;

a membrane having a contracted arrangement and an extended arrangement, the membrane being disposed in the housing in the contracted arrangement and being configured to wrap around the wheel in the extended arrangement, wherein the membrane comprises a net;

a snagging member coupled to the membrane and configured to snag the wheel in the contracted arrangement of the membrane; and an actuator configured to deploy the snagging member from a retracted arrangement to a deployed arrangement, wherein the snagging member is generally enclosed in the housing in the retracted arrangement and is extended from the housing in the deployed arrangement by operation of the actuator.

2. The apparatus according to claim 1 wherein the snagging member is disposed in the housing in the contracted arrangement of the membrane.

3. The apparatus according to claim 1 further comprising an actuator configured to retract the snagging member from a deployed arrangement to a retracted arrangement.

4. The apparatus according to claim 3 wherein the actuator configured to deploy the snagging member from a retracted arrangement to a deployed arrangement comprises the actuator configured to retract the snagging member from a deployed arrangement to a retracted arrangement.

5. The apparatus according to claim 3 wherein the actuator configured to deploy the snagging member from a retracted arrangement to a deployed arrangement does not comprise the actuator configured to retract the snagging member from a deployed arrangement to a retracted arrangement.

6. The apparatus according to claim 1 wherein the actuator comprises at least one of a pneumatic actuator, a pyrotechnical actuator, an electrical actuator, and a resiliently biased actuator.

7. The apparatus according to claim 1 wherein the housing comprises at least one cover configured to move between a closed arrangement of the housing and an open arrangement of the housing, wherein the snagging member is shielded by the cover in the closed arrangement and is exposed in the open arrangement.

8. The apparatus according to claim 1 wherein the housing comprises a frangible seam and the snagging member is configured to penetrate through the frangible seam.

9. The apparatus according to claim 1 wherein the membrane in the contracted arrangement comprises a folded membrane.

10. The apparatus according to claim 9 wherein the snagging member is configured to unfold the membrane from the contracted arrangement to the extended arrangement.

11. The apparatus according to claim 1 wherein the snagging member comprises at least one of a barb, a spike, and a nail.

12. The apparatus according to claim 1 wherein the snagging member is fully enclosed in the housing in the retracted arrangement.

13. The apparatus according to claim 1 wherein the snagging member is partially enclosed in the housing in the retracted arrangement.

14. A system for affecting movement of a vehicle that includes first and second rotating wheels, the system comprising:

a housing configured to be positioned in a path of the vehicle such that the first and second rotating wheels cross the housing;

first and second membranes having contracted and extended arrangements, wherein the first and second membranes comprise a net, the first membrane being disposed in the housing in its contracted arrangement and being configured to wrap around the first wheel in its extended arrangement, and the second membrane being disposed in the housing in its contracted arrangement and being configured to wrap around the second wheel in its extended arrangement;

first and second sets of snags coupled to the first and second membranes, respectively, wherein individual sets of snags are configured to extract an individual membrane from the housing between the contracted and extended arrangements; and a safe/armed mechanism configured to deploy an individual set of snags from a safe arrangement to an armed arrangement, wherein individual snags are generally shielded by the housing in the safe arrangement and are exposed in the armed arrangement.

15. The system according to claim 14, further comprising a controller coupled to the safe/armed mechanism, the controller being configured to provide a signal to the safe/armed mechanism to move an individual set of snags from the safe arrangement to the armed arrangement.

16. The system according to claim 15 wherein the controller comprises a sensor configured to detect the vehicle.

17. The system according to claim 16 wherein the sensor is displaced from the housing.

18. The system according to claim 14 wherein the housing is comprised as a speed-bump configured to be positioned in a path of the vehicle.

19. The system according to claim 14 wherein the safe/armed mechanism is further configured retract an individual set of snags from an armed arrangement to a safe arrangement.

20. A method for affecting movement of a vehicle that includes a rotating wheel, the method comprising:

positioning a housing in a path of the vehicle such that the rotating wheel crosses the housing, the housing enclosing a membrane, wherein the membrane comprises a net, and a snagging member coupled to the membrane;

deploying the snagging member with respect to the housing;

engaging the snagging member with the rotating wheel;

withdrawing the membrane from in the housing; and entangling the membrane around the rotating wheel.

21. The method according to claim 20, further comprising extracting the membrane from a contracted arrangement in the housing to an extracted arrangement entangled with the rotating wheel.

22. The method according to claim 20 wherein exposing the snagging member comprises moving the snagging member from inside the housing to having at least a portion of the snagging member outside the housing.

23. The method according to claim 20 wherein exposing the snagging member comprises opening the housing.

24. The method according to claim 20, further comprising detecting the vehicle and exposing the snagging member in response to detecting the vehicle.

25. The method according to claim 20, further comprising:

packaging the membrane in a package; and positioning the package in the housing.

26. The method according to claim 20, further comprising remotely arming prior to exposing the snagging member with respect to the housing.

27. The method according to claim 20 wherein the snagging member can be selectively exposed or retracted.

* * * * *